US005752418A

United States Patent [19]

Robins

[11] Patent Number: 5,752,418

[45] Date of Patent: May 19, 1998

[54] DUAL SIZE SOCKET DRIVE ADAPTER

[75] Inventor: Terry K. Robins, Minneapolis, Kans.

[73] Assignee: T & L Robins Co., Inc., Minneapolis, Kans.

[21] Appl. No.: 778,448

[22] Filed: Jan. 3, 1997

[51] Int. Cl.[6] ..... B25B 23/16

[52] U.S. Cl. ..... 81/177.2; 81/177.85

[58] Field of Search ..... 81/177.2, 177.85, 81/DIG. 11, 180.1

[56] References Cited

U.S. PATENT DOCUMENTS 2,963,930 12/1960 Clothier et al. ..... 81/177.2
3,227,015 1/1966 Tremblay ..... 81/177.2
4,631,989 12/1986 Trowbridge et al. ..... 81/177.85
4,960,015 10/1990 Mathews ..... 81/177.2
5,168,782 12/1992 Cromwell ..... 81/177.2
5,485,769 1/1996 Olson et al. ..... 81/177.85

*Primary Examiner*—Timothy V. Eley
*Assistant Examiner*—Joni B. Danganan
*Attorney, Agent, or Firm*—Banner & Witcoff, Ltd.

[57] ABSTRACT

A dual size adapter for use in combination with a socket wrench as well as sockets of variable size. The socket adapter includes an internal sliding driver member which projects from one end or the other of the body of the adapter to define a driver of a first cross sectional size in configuration or an alternate cross sectional size in configuration when projected or telescoped from one end or the other end of the adapter body.

8 Claims, 2 Drawing Sheets

DUAL SIZE SOCKET DRIVE ADAPTER

BACKGROUND OF THE INVENTION

This invention relates to a socket drive adapter and more particularly to an adapter which permits the use of a drive ratchet of a first size to drive a socket of a distinct or second size.

Automobile and vehicle mechanics typically utilize socket wrenches wherein a socket drive handle includes a square cross section drive lug or male ratchet which is adapted to fit into the female opening of a socket. Sockets, of course, have variable drive openings depending upon the size of the nut or bolt upon which the socket is to be utilized. The socket drive or ratchet is typically any one of a number of standard sizes such as ½ inch or ⅜ inch. Thus, the compatible sockets which coact with the socket drive must include an appropriately sized female opening in their backside to coact properly with the drive or ratchet.

The use of a ⅜ inch drive socket with a ½ inch drive ratchet, therefore, is not generally possible or practical unless some type of adapter or connector is utilized to effect the size conversion. The present invention contemplates an adapter which has a dual capability of coacting, by way of example, with both a ½ inch drive ratchet, as well as a ⅜ inch drive ratchet in combination with a ⅜ inch drive socket or a ½ inch drive socket. The same device may thus be used to adapt or connect drive ratchets of a first distinct size with a drive socket of a second distinct drive opening size.

SUMMARY OF THE INVENTION

Briefly, the present invention comprises a dual size socket adapter which includes a generally cylindrical body with a throughbore. One end of the throughbore is sized to receive a first size of drive ratchet. The opposite end of the throughbore is sized to receive a second size of drive ratchet. A telescoping driver member is retained within the throughbore and includes opposite active ends that each may be used as a driver. The driver member is axially slidable in the throughbore between a projected position from one end of the body to a projected position from the opposite end of the body. A connector extending between the body and the drive member limits the axial, telescopic movement of the drive member. The socket adapter of the invention may thus receive a first size drive ratchet at one end while projecting a driver from its opposite end of a different size. Alternatively, as the central or longitudinal drive member is translated or telescoped axially within the body from one end to the other, the second end of the adapter may receive a distinct size, drive ratchet and the first end of the adapter will include a projecting driver for a socket of a different size.

Thus, the socket adapter may be utilized to, for example, drive a ⅜ inch drive socket with a ½ inch drive ratchet or alternatively, to drive a ½ inch drive socket in combination with a ⅜ inch drive ratchet. The same adapter may thus be used for both purposes. Additionally, the outer shell of the body may be knurled or otherwise adapted to permit the use of the tool as a spinner or similar device to initially attach or spin on a bolt, for example, onto a threaded nut.

Thus, it is an object of the invention to provide an improved dual size socket adapter for use in combination with a socket wrench or ratchet and sockets of distinct size.

A further object of the invention is to provide an adapter which may be used as a spinner.

Yet another object of the invention is to provide a dual size socket adapter which is comprised of a generally cylindrical body with a hollow throughbore that telescopically receives a slidable driver member that may be extended in either direction from the body to provide a socket drive of a distinctive size.

Yet another object of the invention is to provide a socket adapter which is inexpensive, reasonably easy to manufacture, and yet which provides for multiple uses of a drive ratchet in combination with sockets of various size.

These and other objects, advantages and features of the invention will be set forth in the detailed description which follows.

BRIEF DESCRIPTION OF THE DRAWINGS

In the detailed description as follows, reference will be made to the drawings comprised of the following figures.

DESCRIPTION OF THE PREFERRED EMBODIMENT

Figure 1:
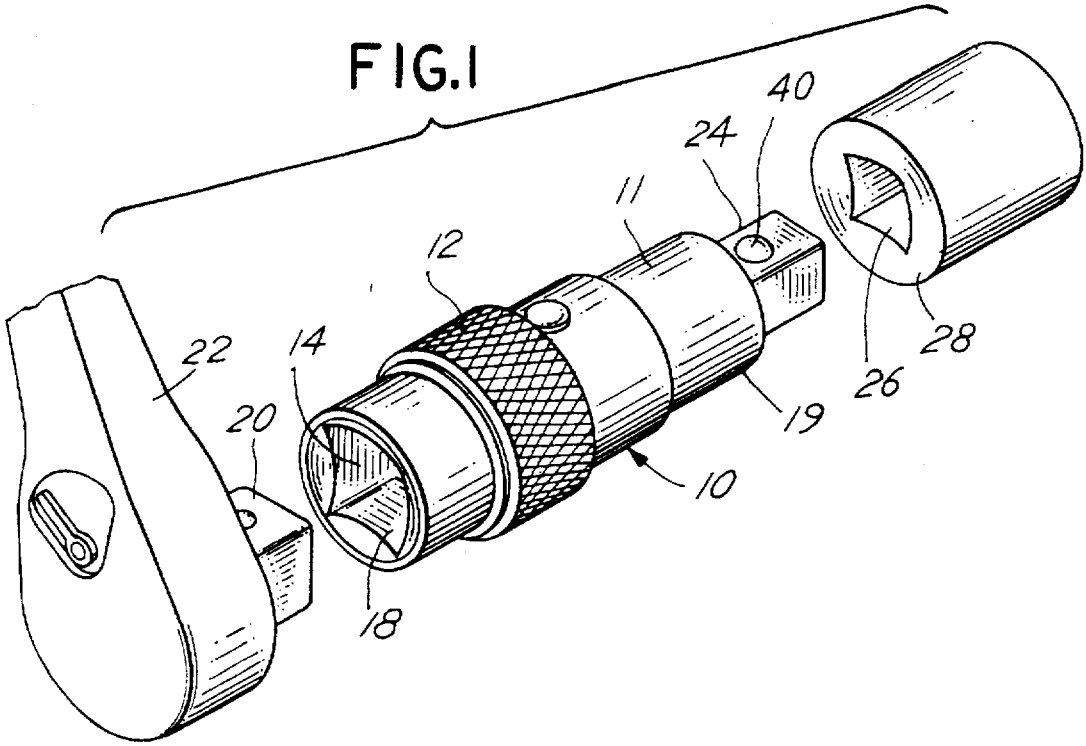
FIG. 1 is a perspective view illustrating the socket adapter of the invention configured to receive a ½ inch drive ratchet and to drive a ⅜ inch drive socket.
Figure 2:
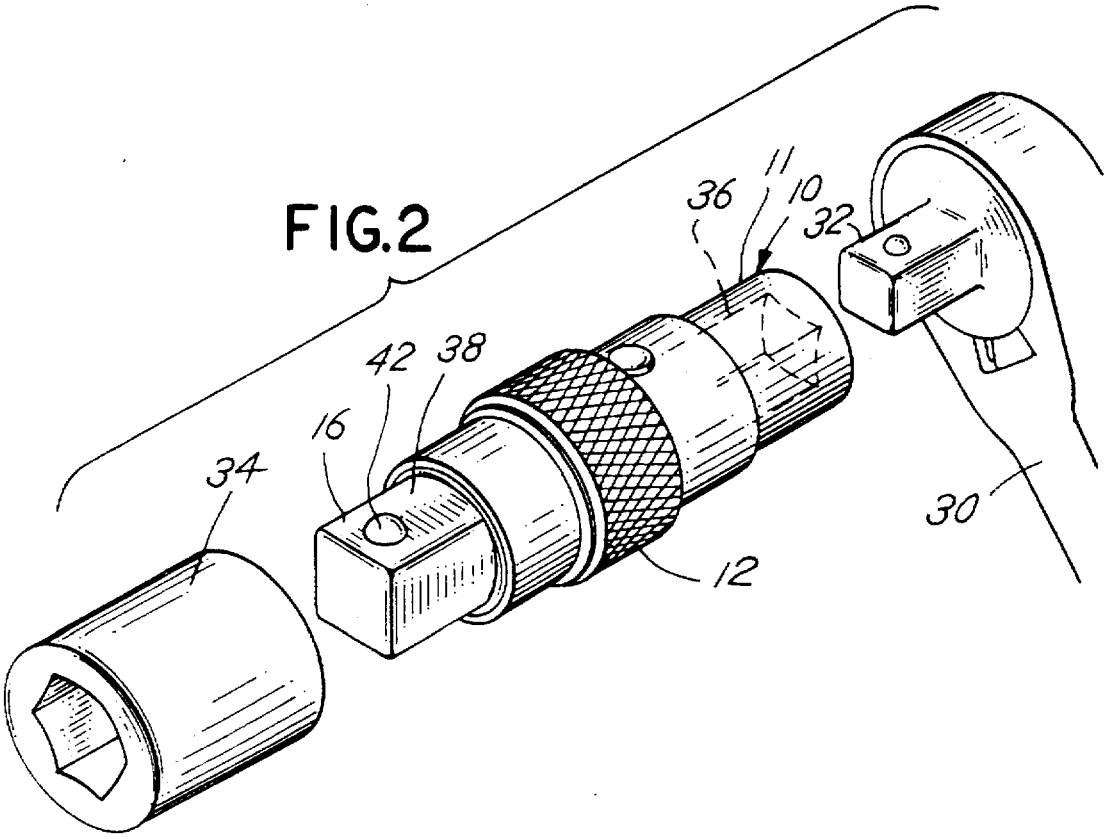
FIG. 2 depicts the adapter of FIG. 1 configured to receive a ⅜ inch drive ratchet to drive a ½ inch drive socket.

Referring to FIGS. 1 and 2, there is illustrated an embodiment of the improved socket adapter 10 of the invention. The socket adapter 10 includes an outer shell or body 11 which is generally cylindrical. A knurled circumferential band 12 may be machined or otherwise incorporated on the outside surface of the body 11. The body 11 includes a throughbore 14 which extends entirely through the body 11. An axially slidable, telescoping driver member 16 is positioned within the throughbore 14. The throughbore 14 at a first end 18 has a first cross sectional configuration and depth which is adapted to receive a drive ratchet 20 associated with a ratchet handle 22. The drive ratchet 20 thus fits into the bore or recess at the first end 18 of the body 11.

The slidable drive member 16 has a length or axial dimension so that it projects from the opposite end 19 of the body 11 and defines a driver end 24 at a second end 19 of the throughbore 14. The driver end 24 is adapted to fit within the female opening, recess or pocket 26 defined in the end of the socket 28. The drive ratchet 20 thus may be a ½ inch drive ratchet and the socket 28 may be a ⅜ inch drive socket having a ⅜ inch generally square bore or recess 26.

FIG. 2 illustrates the manner in which the same adapter 10 may be configured to use a ⅜ inch drive ratchet 30 having a ⅜ inch driver 32 to drive a ½ inch socket 34. Specifically, in FIG. 2 the socket drive member 16 is telescoped in the opposite direction shown in FIG. 1 by axially sliding the driver 16 within the bore 14 through the body 11. In this manner, a recess 36 is defined at the second end 19 of the body 11 of adapter 10 for receipt of the ⅜ inch driver 32. The driver member 16 includes an end 38 compatible with a recess (not shown) in a ½ inch socket 34 so that the socket 34 may be driven, for example, to apply a nut or bolt.

The opposite ends 24 and 38 of the drive member 16 include spring biased detent balls 40 and 42, respectively, which coact with sockets such as sockets 28 and 34 to hold the sockets 28 or 34 onto the drive member 16. The detents 40 and 42 have a second function which is to hold the socket driver member 16 in a desired telescoped position within the bore 14. That is, ball 40 may fit into a detent (not shown) within the bore 14 as may ball 42.

Figure 3:
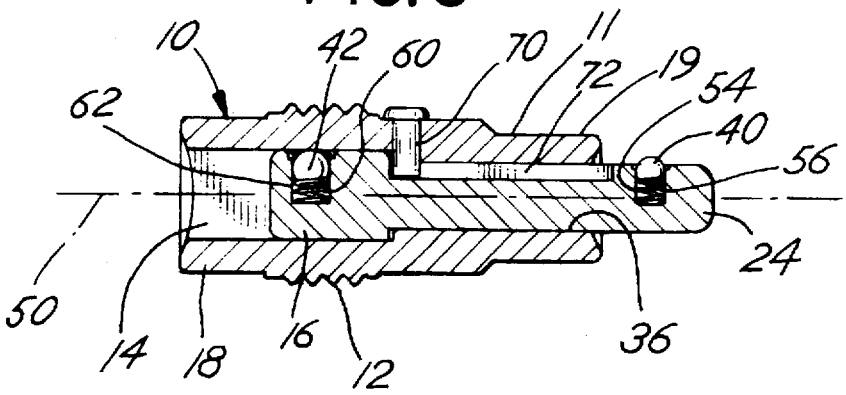
FIG. 3 is a side cross sectional view of the socket adapter of the invention.
Figure 4:
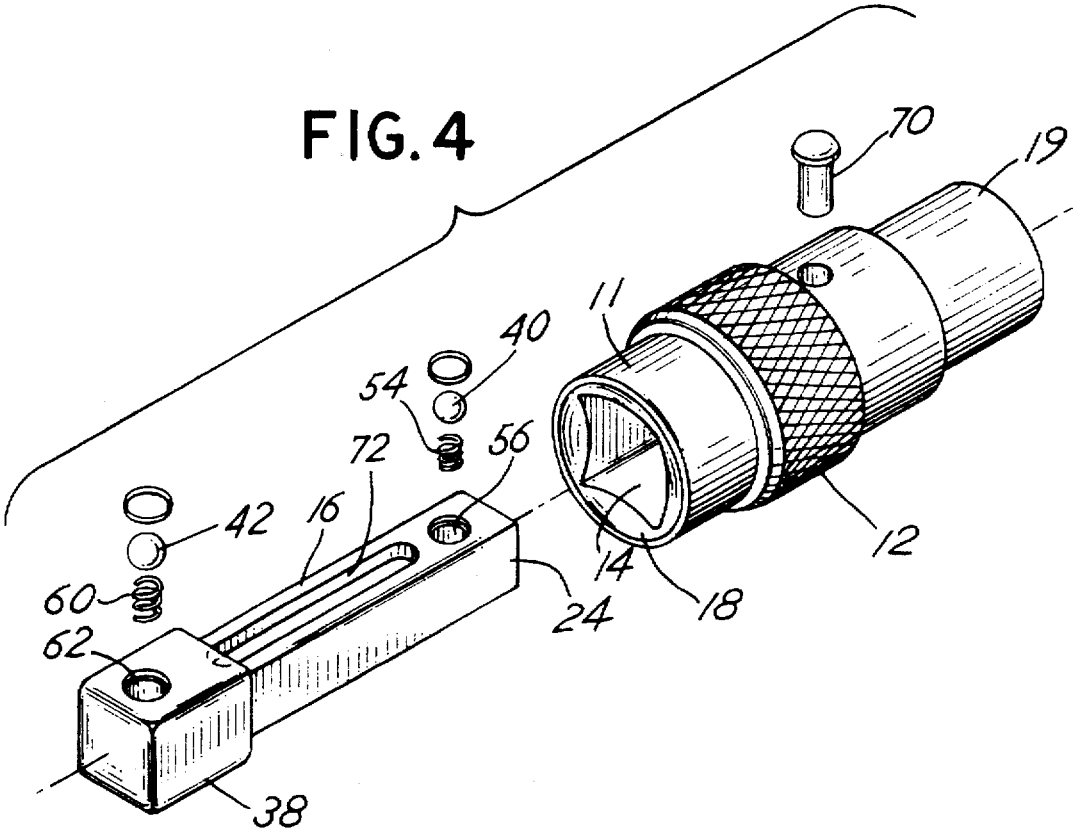
FIG. 4 is an exploded perspective view of the socket adapter of the invention.

FIGS. 3 and 4 illustrate in greater detail the internal construction of the components parts of the adapter 10 of the invention. Thus, the adapter 10 includes a generally cylindrical body 11. The body 11 has a longitudinal axis 50, which in the embodiment depicted, is a center line axis 50. Throughbore 14 through the body 11 has a first rectangular, polygonal cross section end 18 and a second rectangular, polygonal cross section end 19. A driver member 16 also includes a first end 38 which has a cross sectional shape substantially congruent with the shape of the first end 18 of the bore 14 so that the drive member 16 may slide in the bore 14, but may not be easily twisted. The drive member 16 includes a second end 24 which has a cross sectional shape or configuration substantially congruent with that of end 19 of body 11. The body member 16 is thus slidable within the cavity of bore 14.

The body driver member 16 has a longitudinal axis which is generally coincident with the longitudinal axis 50 of the body member 11. The end 24 of the driver member 16 includes a spring biased ball 40 biased by a spring 54 retained within a recess 56 and held in place by a compression ring. Similarly, the opposite end 38 of the driver member 16 includes a ball 42 biased by a spring 60 retained within a recess 62. The ball 42 in FIG. 3 is biased against the inside surface of the bore 14 to help maintain the driver member 16 in position. The ball 40 is positioned so as to engage with a socket, for example socket 28 in FIG. 1.

A connecting pin 70 fits through the body 11 and into a slot 72 defined in the driver member 16. The ends of the slot 72 limit the axial movement of the driver member 16 so that the member 16 may be extended in one direction as a driver as depicted in FIG. 3, or in the opposite direction. Thus, one end 24 can be projected as a driver as limited by one end of slot 72 which coacts with pin 70. Alternatively, the opposite end of the slot 72 limits the travel of the driver member 16 so that the other end 38 of member 16 will project from the body 11 to act as a drive for a socket which is compatible therewith. Sliding the drive member 16 back and forth between the extreme positions thereby converts the socket adapter between a drive member of first size to a drive member of the second size. Note that the slot 72 limits the travel of the drive member 16 in combination with the pin 70. Also note, however, that the polygonal cross section of the end 38 serves to limit the travel of the drive member 16 in one direction and functions to limit any axial twisting movement of member 16.

In a preferred embodiment of the invention the drive member 16 as well as the body member 11 have the same longitudinal dimension. Thus, as a preferred embodiment, the longitudinal dimension between driver ends is approximately two times the maximum extent of the telescopic extension of the driver ends from the body. In practice, then the elements do have the same longitudinal dimension, though variances are possible. The slot 72 has a longitudinal dimension approximately 40% of the elements longitudinal dimension in the preferred embodiment thereby enabling the active or drive ends 38 and 24 to be recessed or projected an adequate amount to serve as a socket or a drive, as the case may be. The slot 72, however, extends at least two times the longitudinal extension of the socket driver member first driver end extension from the bore of the body.

Various connection schemes may be utilized besides that which is disclosed. The length of the component parts, namely, the body 11 and drive member 16, may be varied so long as the drive member may be reciprocated so as to define a socket or a driver, as the case may be. The cross sectional shape of the bore, as well as the driver member end, may also be varied depending upon desired requirements. Thus, the cross sectional shape and the length of the telescoping movement of the driver member 16 are not limiting features of the invention, though it is evident that in the field of mechanics' tools, such sockets and drives are normally square in cross section and have standard sizes (English and metric sizes). The adapter may be used to convert English to metric and vice-versa, also.

Thus, while there has been set forth a preferred embodiment of the invention, it is to be understood that the invention is to be limited only by the following claims and their equivalents.

What is claimed:

1. A dual size socket adapter for use in combination with a socket wrench and sockets comprising, in combination:

a socket body with a longitudinal axis and throughbore, a first end of the bore having a first generally uniform cross sectional configuration and size extending along the longitudinal axis, a second end of the bore having a second, distinct cross sectional size and a generally uniform cross section configuration extending along the longitudinal axis said second size being different from said first size, said bore including an intermediate section between the first and second sections, said intermediate section configured to encompass the cross sectional configuration of at least one of the first or second ends;

a socket driver member telescopically mounted within the socket body, said driver member including a longitudinal axis parallel to the axis of the bore in the body, said driver member and said body having substantial equal longitudinal dimensions, said socket driver including a first driver including a first driver end having a cross sectional dimension substantially equal to a cross sectional dimension of the first end of the bore in the body, said socket driver further including a second driver end having a cross sectional dimension substantially equal to a cross sectional dimension of the second end of the bore in the body, said driver member further including an intermediate section between the first end and the second ends, said intermediate section having a longitudinal slot parallel to the longitudinal axis, said slot extending at least two times the longitudinal extension of the socket driver member first driver end extension from the bore of the body; and a pin extending from the body into the slot to limit the travel of the driver member in the longitudinal direction in the body, whereby the driver member may be telescopically projected from either end of the body to engage a socket while the opposite end of the body is adapted to receive a socket wrench driver.

2. The adapter of claim 1 further including a knurled external surface on at least a portion of the body whereby the adapter may be used as a spinner.

3. The adapter of claim 1 further including a ball detent assembly in at least one end of the socket driver member.

4. The adapter of claim 3 wherein the detent assembly includes a ball biased radially outwardly from a recess in the driver member.

5. The adapter of claim 1 including a ball detent assembly in each driver end of the driver member.

6. The adapter of claim 1 wherein the first and second driver ends of the driver member are congruent respectively with the first and second ends of the bore of the body.

7. The adapter of claim 1 wherein the longitudinal dimension of the first and second driver ends, respectively, is approximately two times the maximum extent of the telescopic extension of the driver ends from the body.

8. A dual size socket adapter comprising, in combination:

a socket body having a longitudinal axis, an axial, longitudinal throughbore in the body, said throughbore having a first polygonal, uniform cross section end section at one end of the bore and a second polygonal, uniform cross section, end section at the other end of the bore, said first polygonal end section having a lesser cross sectional area than the second polygonal end section;

a socket driver member having a longitudinal axis and telescopically mounted in the socket body throughbore, said socket driver member having a first driver end with a cross sectional dimension substantially equal to a cross sectional dimension of the first end section of the bore, and also having a second driver end with a cross sectional dimension substantially equal to a cross sectional dimension of the second end section, the first and second driver ends slidable between an extended position projecting from the body for engagement in a socket to a retracted position within the body whereby a compatible external driver may be inserted in the body bore, the length of the socket driver member being such that a driver end is extended from one end of the body as the other end of the body provides a bore; and a connection between the body and driver member which limits the telescopic movement of the driver member between extended positions from the opposite ends of the socket body.

* * * * *